US007570241B2

(12) United States Patent
Kim et al.

(10) Patent No.: US 7,570,241 B2
(45) Date of Patent: Aug. 4, 2009

(54) LIQUID CRYSTAL DISPLAY DEVICE AND METHOD OF DRIVING THE SAME

(75) Inventors: Chang-Gone Kim, Dae-gu (KR); Jong-Ki Ahn, Dae-gu (KR); Pil-Sung Kang, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 664 days.

(21) Appl. No.: 10/876,631

(22) Filed: Jun. 28, 2004

(65) Prior Publication Data

US 2005/0088392 A1 Apr. 28, 2005

(30) Foreign Application Priority Data

Oct. 23, 2003 (KR) ..... 10-2003-0074365

(51) Int. Cl.
*G09G 3/36* (2006.01)

(52) U.S. Cl. ..... 345/94; 345/93

(58) Field of Classification Search ..... 438/30; 345/87, 94, 204, 205, 93
See application file for complete search history.

(56) References Cited

U.S. PATENT DOCUMENTS

| | | | | |
|---|---|---|---|---|
| 5,686,932 | A * | 11/1997 | Tomita | 345/94 |
| 2003/0151572 | A1* | 8/2003 | Kumada et al. | 345/87 |
| 2004/0115851 | A1* | 6/2004 | Tanaka et al. | 438/30 |
| 2004/0207592 | A1* | 10/2004 | Ludden | 345/96 |

FOREIGN PATENT DOCUMENTS

JP 11-282431 10/1999

* cited by examiner

*Primary Examiner*—Chanh Nguyen
*Assistant Examiner*—Calvin C Ma
(74) *Attorney, Agent, or Firm*—McKenna Long & Aldridge LLP

(57) ABSTRACT

A liquid crystal display device includes a common voltage switching device selectively supplying one of first and second common voltages, a thin film transistor connected to a gate line and a data line, a liquid crystal capacitor connected to the thin film transistor and the common voltage switching device.

16 Claims, 11 Drawing Sheets

LIQUID CRYSTAL DISPLAY DEVICE AND METHOD OF DRIVING THE SAME

This application claims the benefit of Korean Patent Application No. 2003-0074365, filed on Oct. 23, 2003, which is hereby incorporated by reference for all purposes as if fully set forth herein.

BACKGROUND OF THE INVENTION

1. Field of the Invention

The present invention relates to liquid crystal display (LCD) devices. More particularly, the present invention relates to a method of driving a liquid crystal display device while consuming low amounts of power.

2. Discussion of the Related Art

Liquid crystal display (LCD) devices display moving images using switching elements such as thin film transistors (TFTs). Owing to their compact construction and light weight, LCD devices are commonly used in many types of portable devices.

FIG. 1 illustrates an equivalent circuit diagram of a related art LCD device.

Referring to FIG. 1, a related art liquid crystal display (LCD) device generally includes a timing controller 30, a gray level voltage generator 20, a gate driver 40, a data driver 50, and a liquid crystal panel 60.

The timing controller 30 uses video and synchronizing signals output by a central processing unit (not shown) to generate a plurality of driving signals. The driving signals are then applied to the gate driver 40 and the data driver 50 to display images on the liquid crystal panel 60.

The gray level voltage generator 20 provides i-number of gray level voltages $V_1$ to $V_i$, corresponding to i-number of gray levels, to the data driver 50. For example, when input color data has an 8-bit format, the gray level voltage generator 20 generates $2^8$ number of gray level voltages $V_1$ to $V_{256}$, corresponding to 256-gray levels.

The gate driver 40 drives a plurality of gate lines of the liquid crystal panel 60 in accordance with driving signals output by the timing controller 30 while the data driver 50 drives a plurality of data lines of the liquid crystal panel 60 in accordance with driving signal output by the timing controller 30.

The plurality of gate and data lines of the liquid crystal panel 60 cross each other to define a plurality of pixel regions. Thin film transistors (TFTs) T are connected to the gate and data lines at crossings thereof. Specifically, each TFT T includes a gate electrode connected to a gate line and a source electrode connected to a data line. Pixel electrodes (not shown) are connected to drain electrodes of each TFT T. Each TFT T is also connected to a liquid crystal capacitor $C_{LC}$ and a storage capacitor $C_{ST}$. Accordingly, each liquid crystal capacitor $C_{LC}$ is disposed between a corresponding pixel electrode and a common electrode and each storage capacitor $C_{ST}$ is connected to a corresponding pixel electrode.

During one frame of the liquid crystal panel 60, the gate driver 40 sequentially selects the gate lines by supplying a gate signal to each selected gate line. When a gate line is selected, the gate signal is supplied to the gate electrode of each TFT T connected to that gate line, the TFT T is turned on, and a channel is established. Additionally, the data driver 50 supplies a data signal, corresponding to imaging information, which becomes charged within the liquid crystal and storage capacitors $C_{LC}$ and $C_{ST}$ via the TFT T. Once the TFT T is turned off, the liquid crystal and storage capacitors $C_{LC}$ and $C_{ST}$ maintain a voltage associated with the supplied data signal. Accordingly, the storage capacitor $C_{ST}$ can maintain a voltage at the pixel electrode until a subsequent frame.

Generally, the related art LCD device 10 displays images by reorienting alignment characteristics of liquid crystal molecules in accordance with data signals applied to the liquid crystal capacitors $C_{LC}$ and in accordance with electric charges stored within the storage capacitors $C_{ST}$. If the data signal applied to the data lines maintains the same polarity through consecutive frames, the liquid crystal molecules may deteriorate and the display quality of the liquid crystal panel 60 may be degraded. Such deterioration and degradation can be solved by incorporating a data inversion driving method wherein the polarity of applied data signals is inverted in consecutive frames.

Data inversion driving method are generally classified as line inversion, column inversion, or dot invention driving methods. According to the line inversion driving method, data signals having positive (+)and negative (−) polarities are alternately supplied to groups of TFTs T connected to adjacent gate lines. Accordingly, a polarity of voltages at pixel electrodes connected to odd-numbered horizontal lines of TFTs T (i.e., TFTs T that are connected to odd-numbered gate lines) is opposite a polarity of voltages at pixel electrodes connected to even-numbered horizontal lines of TFTs T (i.e., TFTs T that are connected to even-numbered gate lines).

According to the column inversion driving method, data signals having positive (+) and negative (−) polarities are alternately supplied to groups of TFTs T connected to adjacent data lines. Accordingly, a polarity of voltages at pixel electrodes connected to odd-numbered vertical lines of TFTs T (i.e., TFTs T that are connected to odd-numbered data lines) is opposite a polarity of voltages at pixel electrodes connected to even-numbered vertical lines of TFTs T (i.e., TFTs T that are connected to even-numbered data lines).

According to the dot inversion driving method, data signals having positive (+) and negative (−) polarities are alternately supplied to groups of TFTs T connected to adjacent gate and data lines. Accordingly, a polarity of voltages at pixel electrodes connected to odd- and even-numbered ones of TFTs T in horizontal and vertical lines of TFTs T is alternated. Of the various types of data inversion driving methods available, the dot inversion driving method ensures superior display of images and effectively minimizes a flicker phenomenon.

FIGS. 2A and 2B schematically illustrate polarities of voltages at pixel electrodes during consecutive frames when an in-plane switching (IPS) mode liquid crystal display (LCD) device is driven according to the related art dot inversion driving method.

Generally, IPS mode LCD devices include an IPS mode LCD panel 160, a gate driver 140, and a data driver 150. Although not shown, IPS mode LCD devices also include common and pixel electrodes arranged on the same substrate of the IPS mode LCD panel 160. Further, common lines (not shown) are formed on the same substrate on which the gate lines are formed to supply a common voltage Vcom to the pixel region.

Referring to FIGS. 2A and 2B, voltages at horizontally and vertically adjacent pixel electrodes have alternating positive (+) and negative (−) polarities within each frame. Further, polarities of voltages applied to the same pixel electrodes are inverted between consecutive frames. When IPS mode LCD devices are driven according to the dot inversion driving method, a common voltage Vcom, having a fixed value, is applied to a common electrode of each pixel. Accordingly, in each frame, the data driver 150 alternately outputs data signals having positive (+) and negative (−) polarities while a value of the common voltage Vcom is maintained.

An operation of the related art IPS mode LCD device, driving according to the dot inversion driving method, will now be explained in greater detail with reference to FIGS. 2A-2B and 3.

FIG. 3 illustrates a timing chart of waveforms of a data voltage VD, a common voltage Vcom, and a gate voltage VG(n) applied to an IPS mode LCD device in a related art driving method.

Referring to FIG. 3, t1 and t2 represent first and second time periods, respectively, of first and second frames, during which the gate voltage VG(n) is output to an $(n)^{th}$ gate line.

As shown in FIGS. 2A-2B and 3, when the gate driver 140 supplies the gate voltage VG(n) to the $(n)^{th}$ gate line during a first time period t1 of the $1^{st}$ frame, TFTs T connected to the $(n)^{th}$ gate line are turned on. At this time, the $(n)^{th}$ $(m)^{th}$ pixel receives a common voltage Vcom and the data driver 150 supplies a data voltage VD having a value of $Vcom+V_2$ to the $(m)^{th}$ data line to supply the $(n)^{th}\cdot(m)^{th}$ pixel with the data voltage VD ($Vcom+V_2$) via the TFT T. Therefore, the $(n)^{th}\cdot(m)^{th}$ pixel has a positive (+) voltage $V_2$ (i.e., a voltage value equal to the difference between the data voltage VD having the positive polarity (+) and the common voltage Vcom) and reorients liquid crystal molecules within the $(n)^{th}\cdot(m)^{th}$ pixel accordingly.

After the first time period t1 of the $1^{st}$ frame, the gate voltage VG(n) ceases to be output but the voltage $V_2$ is maintained at the pixel electrode during the remainder of the first frame because voltages are charged within the liquid crystal and storage capacitors $C_{LC}$ and $C_{ST}$. As the first frame progresses, voltages charged in the liquid crystal capacitor $C_{LC}$ and the storage capacitor $C_{ST}$ are slightly reduced due to a leakage current within the device.

During a second time period t2 of the $2^{nd}$ frame (i.e., the frame immediately after the $1^{st}$ frame), the gate voltage VG(n) is supplied to the $(n)^{th}$ gate line and TFTs T connected to the $(n)^{th}$ gate line are turned on. At this time, the $(n)^{th}\cdot(m)^{th}$ pixel receives the common voltage Vcom as in the $1^{st}$ frame. However, the data driver 150 supplies a second data voltage VD having a value of $Vcom-V_2$ to the $(m)^{th}$ data line to supply the $(n)^{th}$. $(m)^{th}$ pixel with the data voltage VD ($Vcom-V_2$) via the TFT T. Therefore, and unlike the $1^{st}$ frame, the $(n)^{th}\cdot(m)^{th}$ pixel has a negative (−) voltage $V_2$ (i.e., a voltage value equal to the difference between the data voltage VD having the negative polarity (−) and the common voltage Vcom) and reorients liquid crystal molecules within the $(n)^{th}\cdot(m)^{th}$ pixel accordingly.

Thus, during the $1^{st}$ and $2^{nd}$ frames, the data driver 150 supplies the $(n)^{th}\cdot(m)^{th}$ pixel voltages $V_2$ and $V_2$ having positive (+) and negative (−) polarities and a voltage difference of ΔV. The voltage difference ΔV can be calculated by the following equation:

$$\Delta V=(Vcom+V_2)-(Vcom-V_2)=2V_2$$

FIG. 4 illustrates a gamma curve of the data driver when an IPS mode LCD device is driven with the common voltage Vcom in a related art driving method.

Referring to FIG. 4, if the related art IPS mode LCD device is driven using the 8-bit format, the data driver 150 outputs a gray level voltage VD having 256-gray levels. Accordingly, the output data voltage VD can have a positive polarity when a value of the output data voltage VD is greater than the common voltage Vcom or a negative polarity when a value of the output data voltage VD is less than the common voltage Vcom.

As described above, polarities of voltages applied to pixels driven according to the dot inversion driving method are inverted (i.e., (+) to (−) or (−) to (+)) in every column period. Therefore, if the value of the output data voltage VD is large when its polarity is inverted, the value of the voltage difference ΔV generated by the data driver 150 will also be large. For example, if the value of a voltage at a pixel is V0(i.e., the highest illustrated voltage value having a positive polarity) when its polarity inverted, the value of the voltage difference ΔV is equal to the difference between voltage values V0 and V17(i.e., the lowest illustrated voltage value having a negative polarity). As a result, the data driver 150 must drive the IPS mode LCD device using a high-voltage drive.

IPS mode LCD devices are driven at increased bit rates to display images having high resolution and color. Therefore, the driving voltages output by the data driver 150 increase as the bit rate increases and the data driver 150 must be able to generate data voltages VD having large magnitudes. However, data drivers which are capable of generating such data voltages VD must consume large amounts of power, incorporate complex circuitry and are, therefore, complex and expensive to fabricate, and expensive to operate.

SUMMARY OF THE INVENTION

Accordingly, the present invention is directed to a liquid crystal display device and a method of driving a liquid crystal display device that substantially obviates one or more of the problems due to limitations and disadvantages of the related art.

An advantage of the present invention provides a liquid crystal display device and a method of driving a liquid crystal display device where a power consumption is reduced without an additional external circuit.

Additional features and advantages of the invention will be set forth in the description which follows, and in part will be apparent from the description, or may be learned by practice of the invention. These and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device may, for example, include a common voltage switching device selectively supplying one of first and second common voltages; a thin film transistor connected to a gate line and a data line; and a liquid crystal capacitor connected to the thin film transistor and the common voltage switching device.

In another aspect of the present invention, a liquid crystal display device may, for example, include first and second gate lines; first and second data lines; first and second common voltage switching devices, wherein each of the first and second common voltage switching devices selectively supplies one of first and second common voltages; a first thin film transistor connected to the first data line and the first gate line; a second thin film transistor connected to the second data line and the second gate line; a third thin film transistor connected to the second data line and the first gate line; a fourth thin film transistor connected to the first data line and the second gate line; a first liquid crystal capacitor connected to the first thin film transistor and the fist common voltage switching device; a second liquid crystal capacitor connected to the second thin film transistor and the first common voltage switching device; a third liquid crystal capacitor connected to the third thin film transistor and the second common voltage switching device; and a fourth liquid crystal capacitor connected to the fourth thin film transistor and the second common voltage switching device.

According to principles of the present invention, a method of driving a liquid crystal display device may, for example, include supplying a gate line with a gate voltage during a first frame; supplying a first common voltage to a liquid crystal capacitor through a common voltage switching device during the first frame; supplying the gate line with the gate voltage during a second frame; and supplying a second common voltage to the liquid crystal capacitor through the common voltage switching device during the second frame, wherein the common voltage switching device selects one of first and second voltages.

According to principles of the present invention, a method of driving a liquid crystal display device may, for example, include outputting a gate voltage to a gate line during a first frame; supplying a first common voltage to a first liquid crystal capacitor through a first common voltage switching device and a second common voltage to a second liquid crystal capacitor through a second common voltage switching device during the first frame; outputting the gate voltage to the gate line during a second frame; and supplying the second common voltage to the first liquid crystal capacitor through the first common voltage switching device and the first common voltage to the second liquid crystal capacitor through the second common voltage switching device during the second frame, wherein each of the first and second common voltage switching devices selects one of the first and second voltages and wherein the first and second liquid crystal capacitors are adjacent to each other along the gate line.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, similar reference numbers will be used throughout the drawings to refer to the same or like parts.

Figure 1:
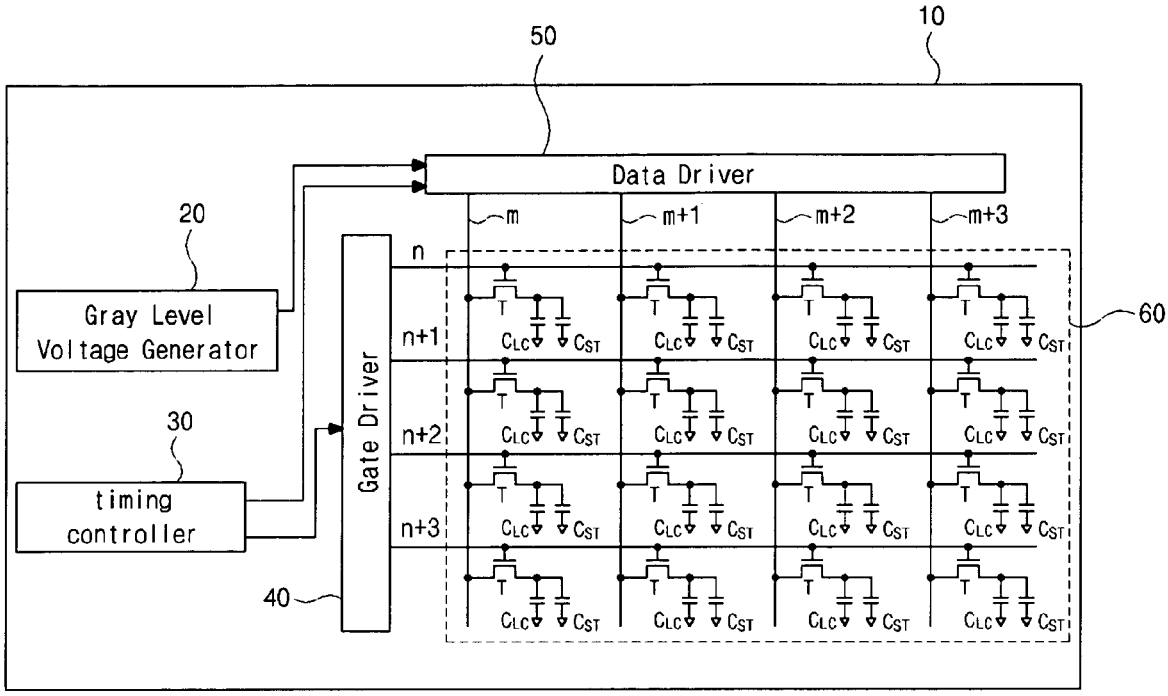
FIG. 1 (Related Art)
FIG. 1 illustrates an equivalent circuit diagram of a related art liquid crystal display (LCD) device.
Figure 2A:
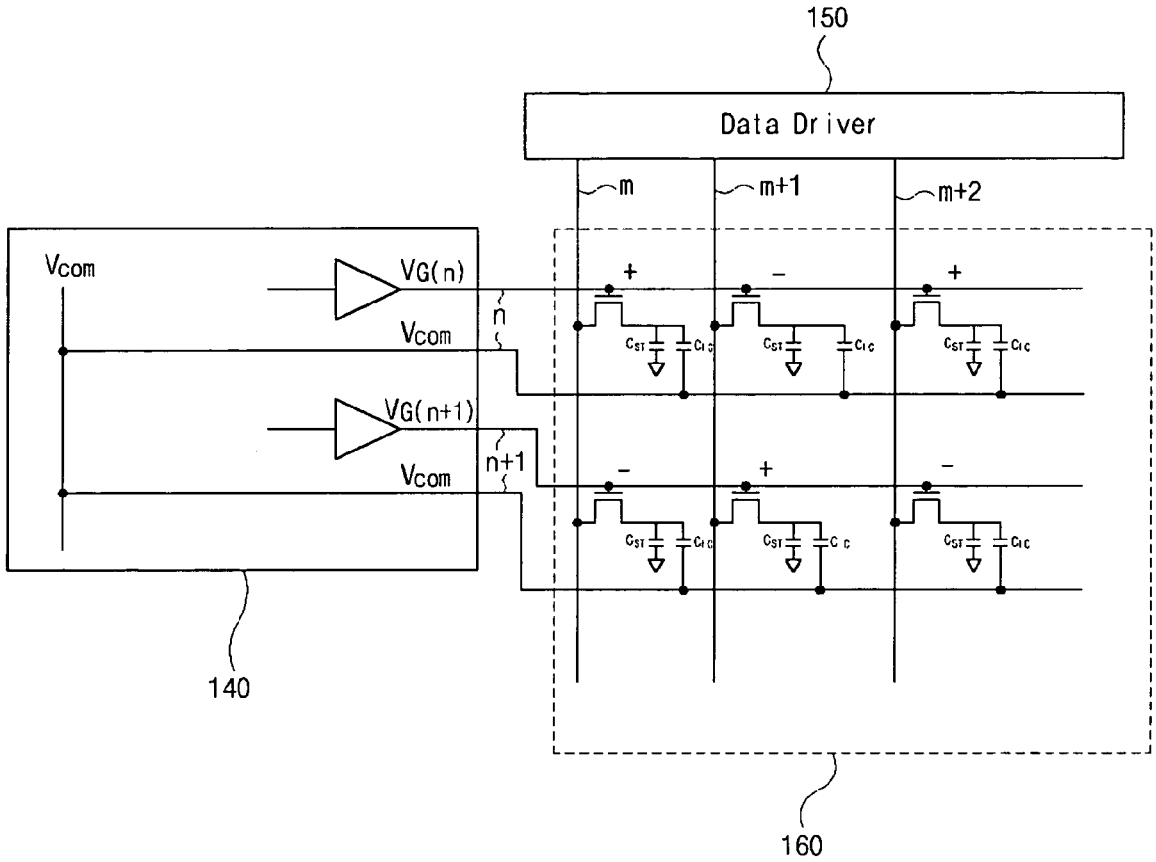
FIG. 2A (Related Art)
FIGS. 2A and 2B schematically illustrate polarities of voltages at pixel electrodes during consecutive frames when an in-plane switching (IPS) mode LCD device is driven according to the related art dot inversion driving method according.
Figure 2B:
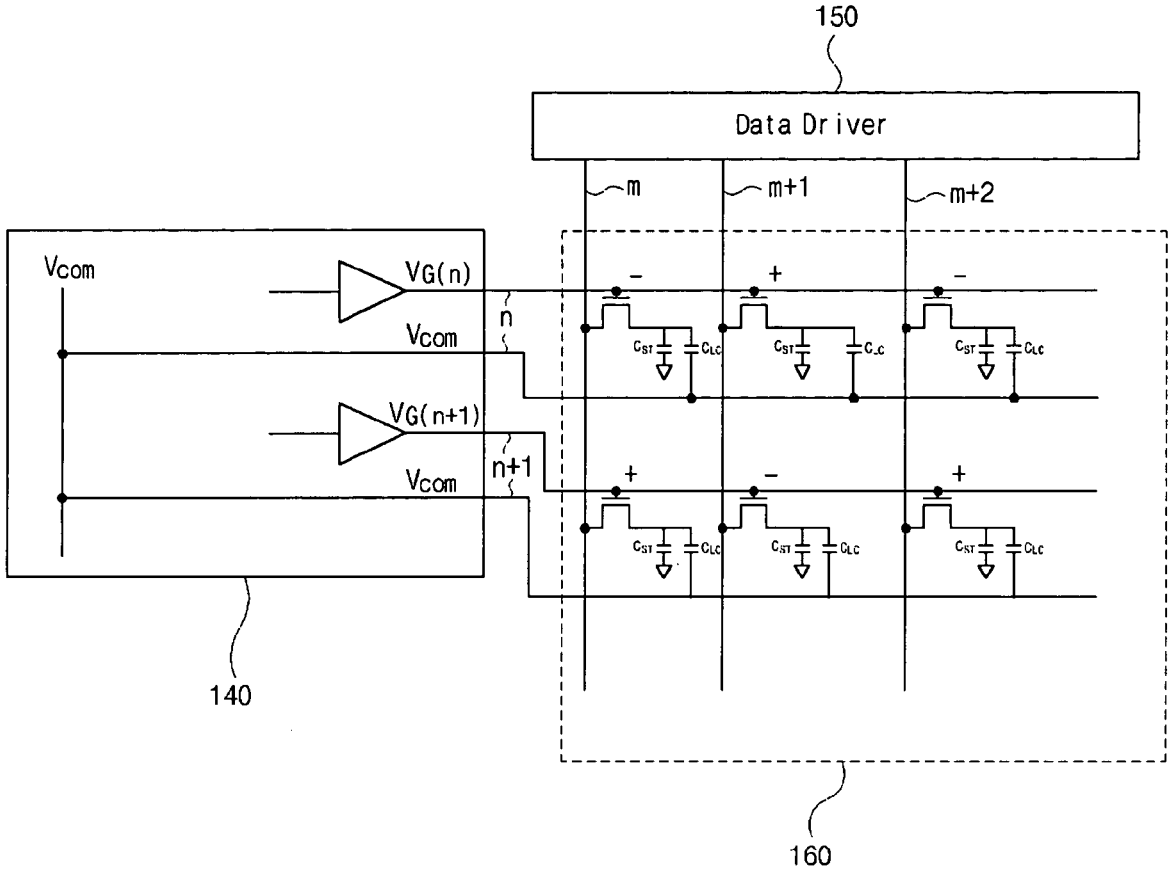
FIG. 2B (Related Art)
Figure 3:
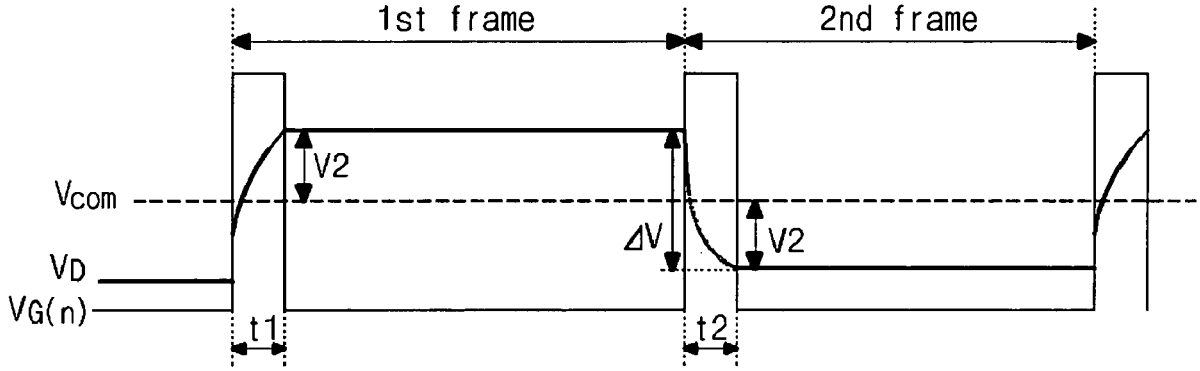
FIG. 3 (Related Art)
FIG. 3 illustrates a timing chart of waveforms of a data voltage, a common voltage, and a gate voltage applied to an IPS mode LCD device in a related art driving method.
Figure 4:
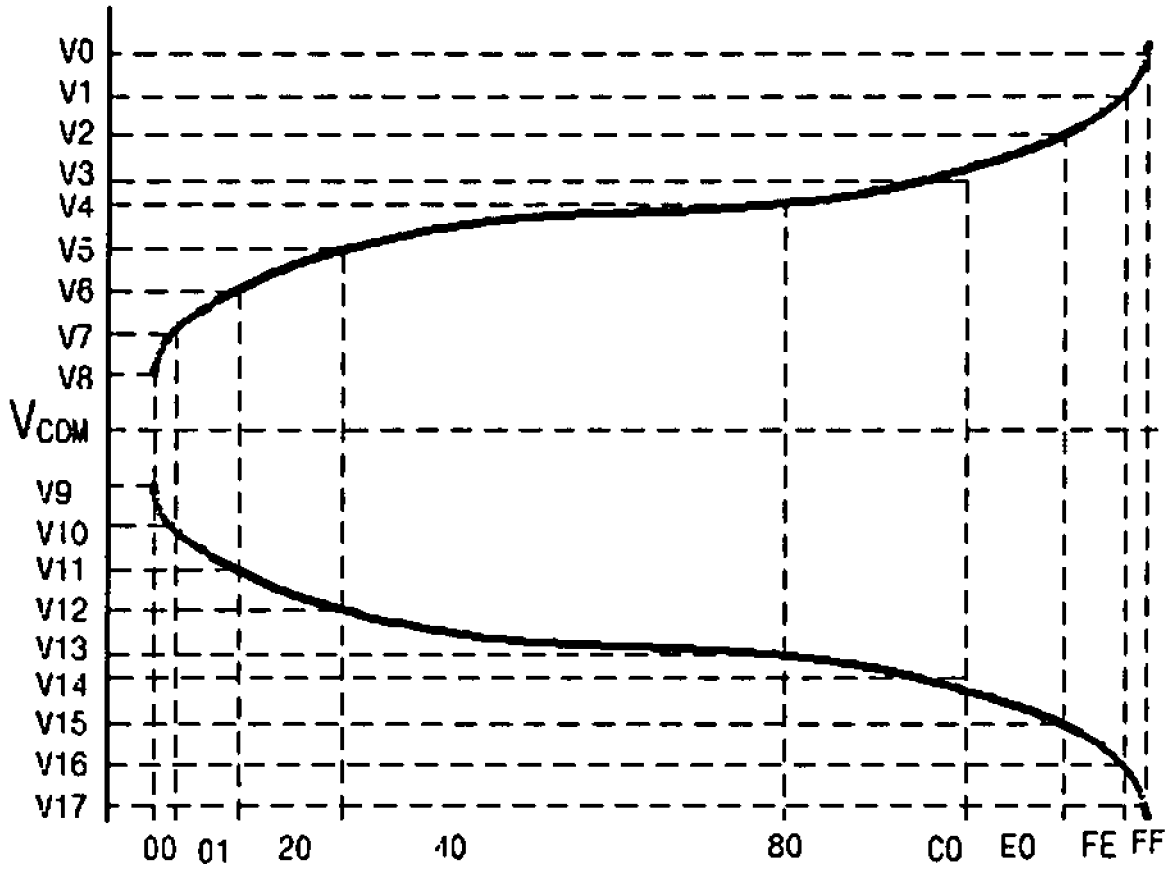
FIG. 4 (Related Art)
FIG. 4 illustrates a gamma curve of the data driver when an IPS mode LCD device is driven with the common voltage in a related art driving method.
Figure 5:
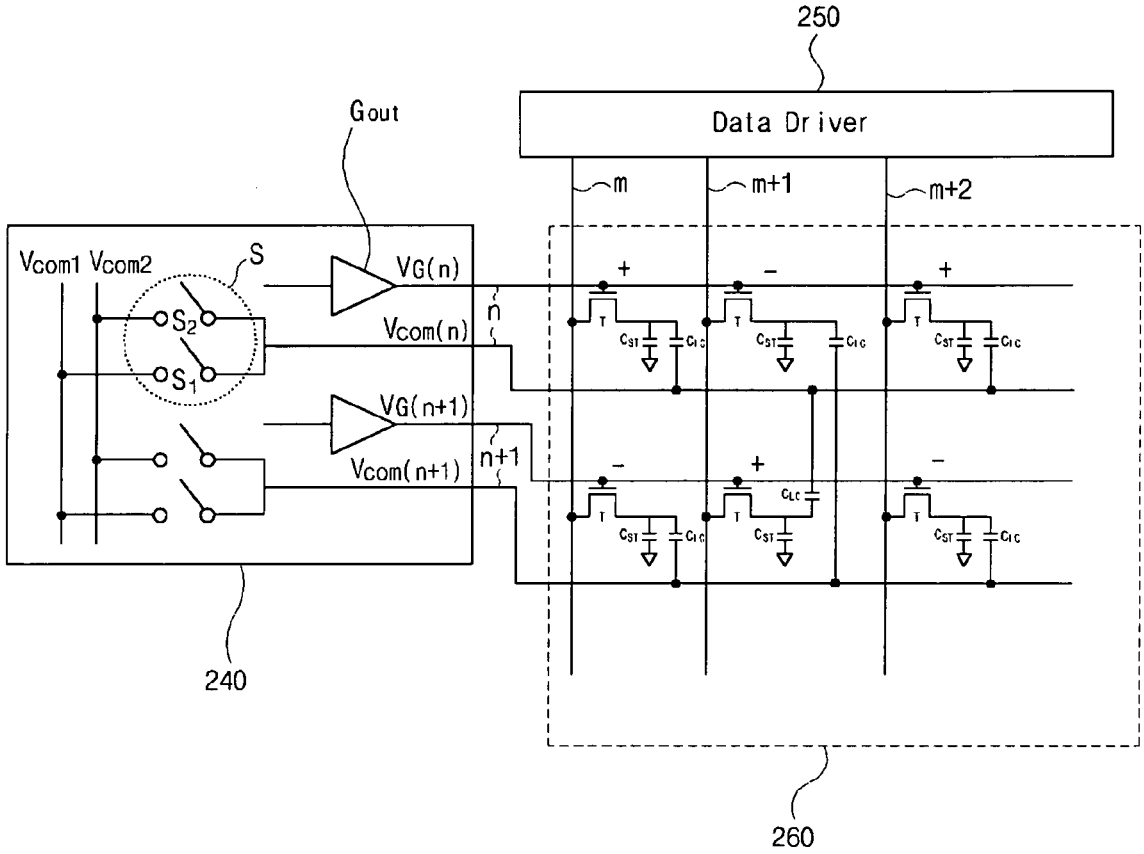
FIG. 5 illustrates an equivalent circuit diagram of an IPS mode LCD device according to principles of the present invention.

FIG. 5 illustrates an equivalent circuit diagram of an IPS mode LCD device according to principles of the present invention.

Referring to FIG. 5, an IPS mode LCD device according to principles of the present invention may, for example, include a liquid crystal panel 260, a gate driver 240, and a data driver 250.

The liquid crystal panel 260 may, for example, include a plurality of gate lines a plurality of data lines crossing the gate lines, and a plurality of TFTs T connected to the gate and data lines at crossings thereof. In one aspect of the present invention, each TFT T may, for example, include a gate electrode connected to an $(n)^{th}$ gate line and a source electrode connected to an $(m)^{th}$ data line. Pixel electrodes (not shown) are connected to drain electrodes of each TFT T. The liquid crystal panel 260 also includes a liquid crystal capacitor $C_{LC}$ and a storage capacitor $C_{ST}$ that are connected to the thin film transistor T. Each TFT T may also be connected to a liquid crystal capacitor $C_{LC}$ and a storage capacitor $C_{ST}$. Accordingly, each liquid crystal capacitor $C_{LC}$ may be disposed between a corresponding pixel electrode and a common electrode and each storage capacitor $C_{ST}$ is connected to a corresponding pixel electrode.

According to principles of the present invention, each liquid crystal capacitor $C_{LC}$ may be connected to the common electrode via predetermined ones of a plurality of common lines. In one aspect of the present invention, alternating ones of liquid crystal capacitors $C_{LC}$ connected to a horizontal row of pixel electrodes may be connected to an adjacent common line and to a common line connected to an adjacent horizontal row of pixel electrodes.

The gate driver 240 may, for example, include a plurality of gate voltage output devices $G_{out}$ and a plurality of common voltage switching devices S. In one aspect of the present invention, the gate voltage output devices $G_{out}$ may supply gate signals to the plurality of gate lines. In another aspect of the present invention, each common voltage switching device S may selectively provide a first common voltage Vcom1 or a second common voltage Vcom2 to pixels of the liquid crystal panel 260 via, for example, the plurality of common lines.

According to principles of the present invention, each common voltage switching device S may, for example, include a first switch S1 and a second switch S2 to selectively supply either the first or second common voltage Vcom1 or Vcom2. Accordingly, an $(n)^{th}$ common voltage switching device S may be connected to an $(n)^{th}\cdot(m)^{th}$ pixel, an $(n+1)^{th}\cdot(m+1)^{th}$ pixel, an $(n)^{th}\cdot(m+2)^{th}$ pixel, an $(n+1)^{th}\cdot(m+3)^{th}$ pixel, an $(n)^{th}\cdot(m+4)^{th}$ pixel, etc., via an $(n)^{th}$ common line. Similarly, an $(n+1)^{th}$ common voltage switching device S may be connected to an $(n+1)^{th}\cdot(m)^{th}$ pixel, an $(n)^{th}\cdot(m+1)^{th}$ pixel, an $(n+1)^{th}\cdot(m+2)^{th}$ pixel, an $(n)^{th}\cdot(m+_3)^{th}$ pixel, an $(n+1)^{th}\cdot(m+_4)^{th}$ pixel, etc., via an $(n+1)^{th}$ common line.

When the IPS mode LCD device described above is driven according to a dot inversion driving method, within each frame and between consecutive frames, adjacent ones of common voltage switching devices S alternately supply the first and second common voltages Vcom1 and Vcom2 to corresponding common lines such that horizontally and vertically adjacent ones of pixels are charged with voltages of opposite polarities. For example, when the $(n)^{th}$ common voltage switching device S supplies the first common voltage Vcom1 to the $(n)^{th}$ common line, the $(n+1)^{th}$ common voltage switching device S supplies the second common voltage Vcom2 to the $(n+1)^{th}$ common line. Accordingly, odd-numbered pixels of the $(n)^{th}$ row and even-numbered pixels of the $(n+1)^{th}$ row are supplied with the first common voltage Vcom1 while even-numbered pixels of the $(n)^{th}$ row and odd-numbered pixels of the $(n+1)^{th}$ row are supplied with the second common voltage Vcom2.

Figure 6:
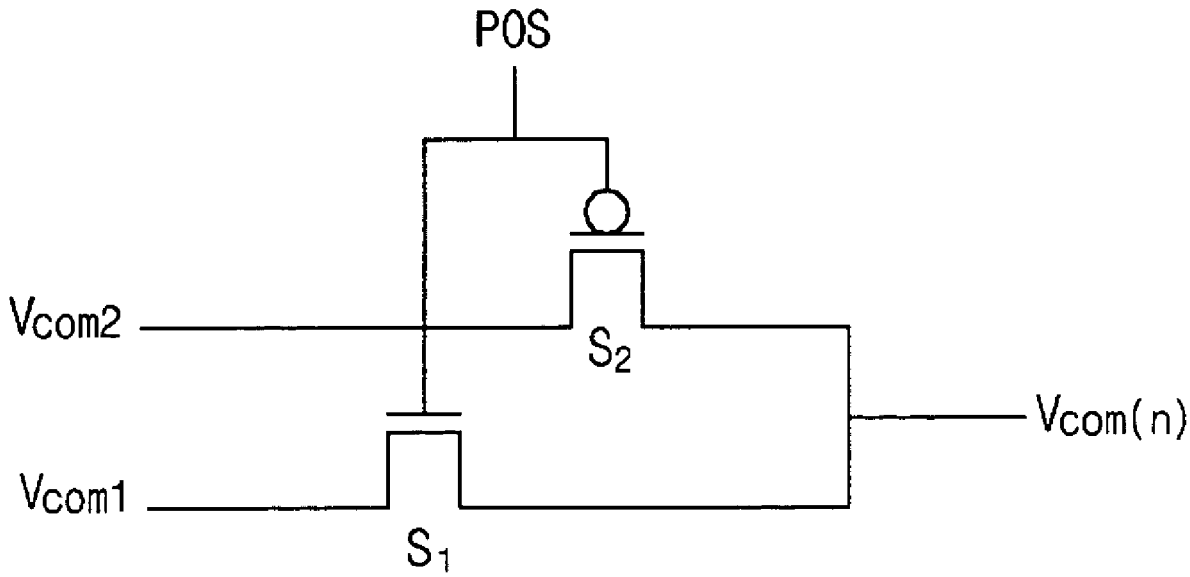
FIG. 6 illustrates a circuit diagram of a common voltage switching device according to principles of the present invention.

FIG. 6 illustrates a circuit diagram of a common voltage switching device according to principles of the present invention.

Referring to FIG. 6, each common voltage switching device S may, for example, include a first switch S1, a second switch S2, and a polarity reverse signal (POS) terminal. In one aspect of the present invention, the first switch S1 may, for example, be a negative type (n-type) switch that receives the first common voltage Vcom1. In another aspect of the present invention, the second switch S2 may, for example, be a positive type (p-type) switch that receives the second common voltage Vcom2. In still another aspect of the present invention, the polarity reverse signal (POS) terminal may receive POS signals output from a timing controller (not shown) and controls the first and second switches S1 and S2 of the common voltage switching device S in accordance with the POS signals. For example, when the POS signal comprises a negative (−) signal, the second switch S2 may be turned on while the first switch S1 may be turned off. Thus, in the presence of a negative (−) POS signal, the common voltage switching device S may output the second common voltage Vcom2. Moreover, when the POS signal comprises a positive (+) signal, the first switch S1 may be turned on while the second switch S2 may be turned off. Thus, in the presence of a positive (+) POS signal, the common voltage switching device S may output the first common voltage Vcom1. Having described the IPS mode LCD and common voltage switching device S according to the principles of the invention, an operation of the present IPS mode LCD and common voltage switching devices will now be explained in greater detail with reference to FIGS. 7 and 8A-8B.

Figure 7:
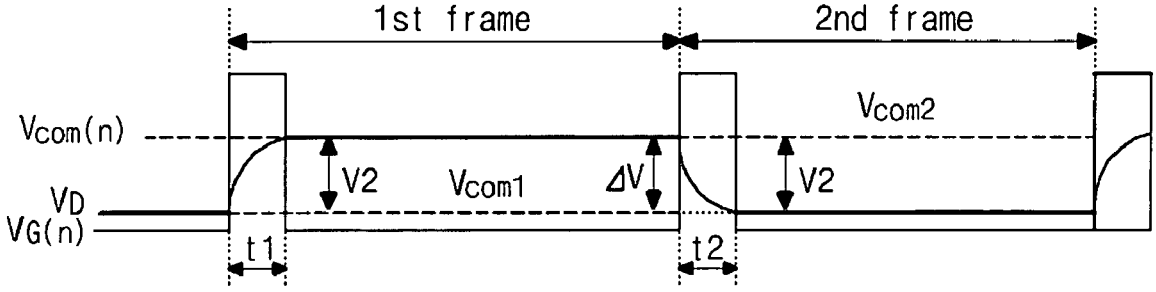
FIG. 7 illustrates a timing chart of waveforms of a data voltage, a common voltage, and a gate voltage applied to an IPS mode LCD device in a driving method according to principles of the present invention.
Figure 8A:
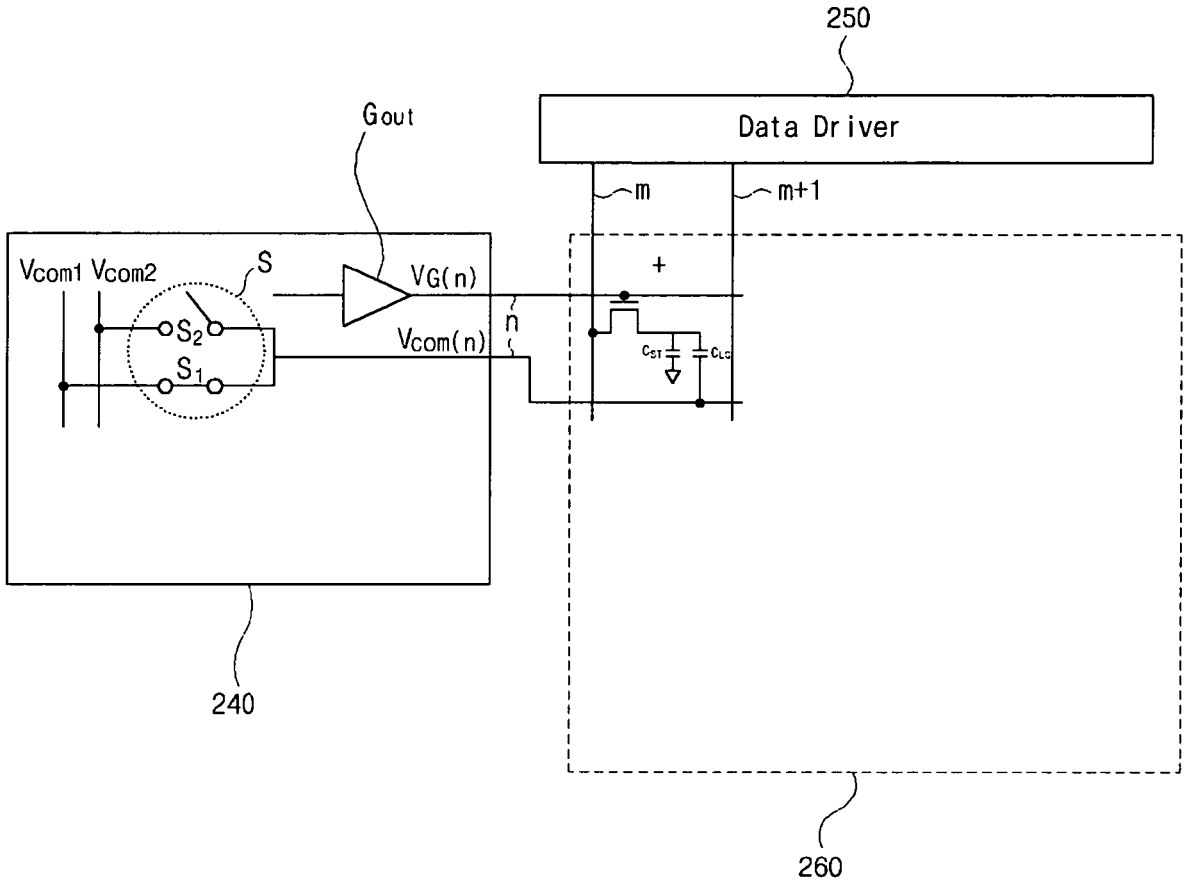
FIGS. 8A and 8B schematically illustrate polarities of a voltage at a pixel electrode during consecutive frames when IPS mode LCD device is driven according to a dot inversion driving method according to principles of the present invention.
Figure 8B:
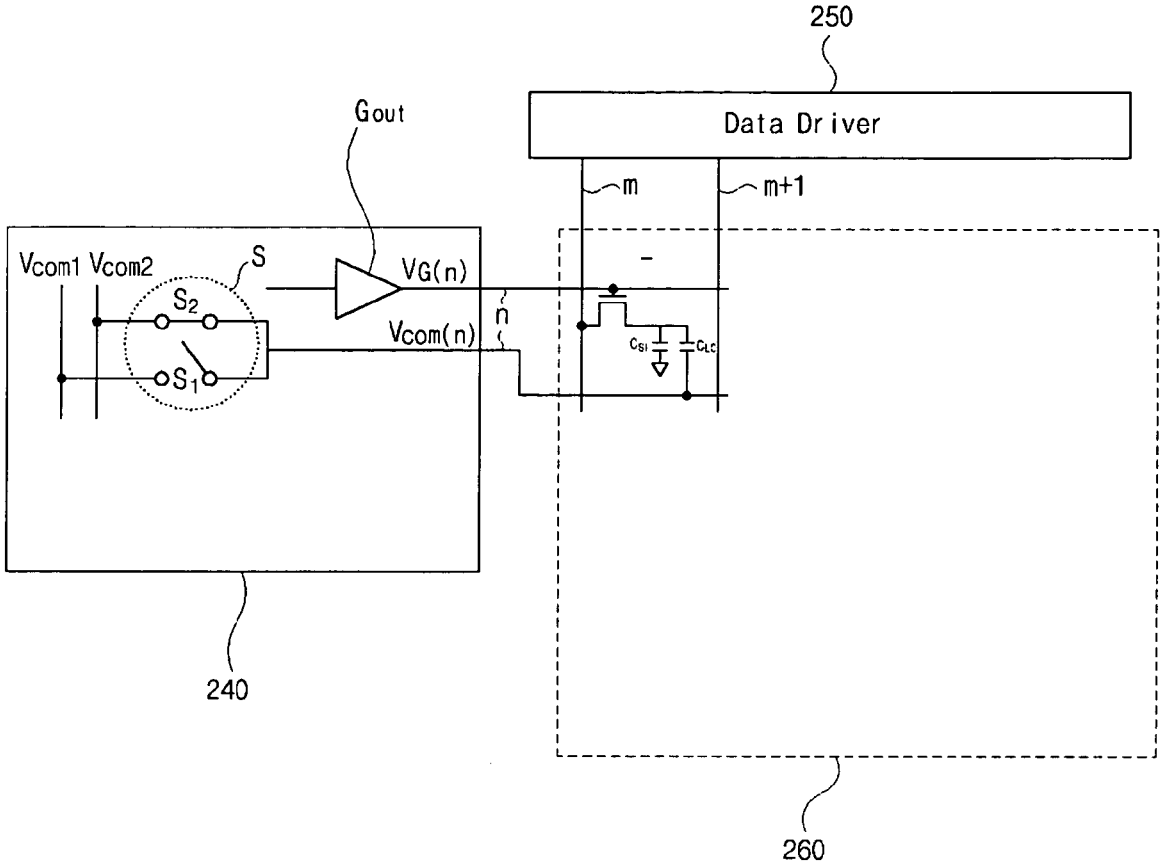

FIG. 7 illustrates a timing chart of waveforms of a data voltage, a common voltage, and a gate voltage applied to an IPS mode LCD device in a driving method according to principles of the present invention. FIGS. 8A and 8B schematically illustrate polarities of a voltage at a pixel electrode during consecutive frames when IPS mode LCD device is driven according to a dot inversion driving method according to principles of the present invention.

Referring to FIG. 7, VG(n), VD, and Vcom(n) respectively represent a gate voltage, a data voltage, and a common voltage all of which are applied to the $(n)^{th}\cdot(m)^{th}$ pixel. Specifically, the gate voltage VG(n) is applied to the $(n)^{th}$ gate line as shown in FIG. 5, the data voltage VD is applied to the $(m)^{th}$ data line as shown in FIG. 5, and the common voltage Vcom (n) is applied to the $(n)^{th}$ common line as shown in FIG. 5. Further, t1 and t2 represent first and second time periods, respectively, of first and second frames, during which the gate voltage VG(n) is output to the $(n)^{th}$ gate line. According to principles of the present invention, the first and second common voltages Vcom1 and Vcom2 have different values. In one aspect of the present invention, a value of the second common voltage Vcom2 may be greater than a value of the first common voltage Vcom1(i.e., Vcom2>Vcom1).

As shown in FIGS. 7 and 8A-8B, when the gate driver 240 supplies the gate voltage VG(n) to the $(n)^{th}$ gate line during a first time period t1 of the $1^{st}$ frame, the TFTs T connected to the $(n)^{th}$ gate line are turned on. At this time, the $(n)^{th}$ common voltage switching device S within the gate driver 240 may, for example, receive a POS signal having a positive (+) polarity, turning the first switch S1 on, turning the second switch S2 off, and causing the $(n)^{th}$ common voltage switching device to apply the first common voltage Vcom1 to the $(n)^{th}$ common line and to the $(n)^{th}\cdot(m)^{th}$ pixel. Further, the data driver 250 supplies a data voltage VD having a value of $Vcom1+V_{2h}$ to the data line $(m)^{th}$ data line to supply the $(n)^{th}\cdot(m)^{th}$ pixel with the data voltage VD ($Vcom1+V_{2h}$) via the TFT T. Therefore, and as shown in FIG. 8A, the $(n)^{th}\cdot(m)^{th}$ pixel has the positive (+) voltage $V_{2h}$ (i.e., a voltage value equal to the difference between the data voltage VD and the common voltage Vcom1) and reorients liquid crystal molecules within the $(n)^{th}\cdot(m)^{th}$ pixel accordingly.

After the first time period t1 of the $1^{st}$ frame, the gate voltage VG(n) ceases to be output but the voltage $V^{2h}$ is maintained at the pixel electrode during the remainder of the first frame because voltages are charged within the liquid crystal and storage capacitors $C_{LC}$ and $C_{ST}$. As the first frame progresses, voltages charged in the liquid crystal capacitor $C_{LC}$ and the storage capacitor $C_{ST}$ are slightly reduced due to a leakage current within the device.

During a second time period t2 of the $2^{nd}$ frame (i.e., the frame immediately after the $1^{st}$ frame), the gate voltage VG(n) is supplied to the $(n)^{th}$ gate line and TFTs T connected to the $(n)^{th}$ gate line are turned on. At this time, the $(n)^{th}$ common voltage switching device S within the gate driver 240 may, for example, received a POS signal having a negative (−) polarity, turning the first switch S1 off, turning the second switch S2 on, and causing the $(n)^{th}$ common voltage switching device to apply the second common voltage Vcom2 to the $(n)^{th}$ common line and to the $(n)^{th}\cdot(m)^{th}$ pixel. Further, the data driver 250 supplies the data voltage VD having a value of $Vcom2-V_2$ to the $(m)^{th}$ data line to supply the $(n)^{th}\cdot(m)^{th}$ pixel with the data voltage VD ($Vcom2-V_2$) via the TFT T. Therefore, and as shown in FIG. 8B, the $(n)^{th}\cdot(m)^{th}$ pixel has the negative (−) voltage $V_2$ (i.e., a voltage value equal to the difference between the data voltage VD and the common voltage Vcom2) and reorients liquid crystal molecules within the $(n)^{th}\cdot(m)^{th}$ pixel accordingly.

Thus, during the $1^{st}$ and $2^{nd}$ frames, the data driver 250 supplies the $(n)^{th}\cdot(m)^{th}$ pixel voltages $V_2$ having a voltage difference of ΔV. The voltage difference ΔV can be calculated by the following equation:

$$\Delta V=(Vcom1+V_2)-(Vcom2-V_2)=2V_2-(Vcom2-Vcom1).$$

As described above, the second common voltage Vcom2 is greater than the first common voltage Vcom1 (Vcom2>Vcom1). Therefore, the voltage difference ΔV is less than twice the value of the supplied data voltage VD (i.e., $\Delta V<2V_2$). Consequently, the voltage difference ΔV of the data voltage VD, required to be output by the data driver 250, decreases upon increasing a value of the second common voltage Vcom2 over the value of the first common voltage Vcom1, thereby decreasing the power consumption of the data driver 250.

Figure 9A:
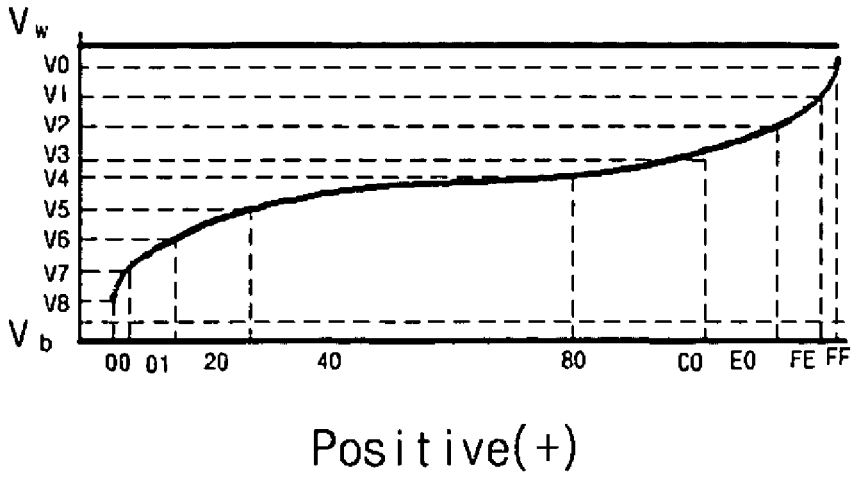
FIGS. 9A and 9B illustrate gamma curves of the data driver the IPS mode LCD device is driven with the common voltage according to principles of the present invention.
Figure 9B:
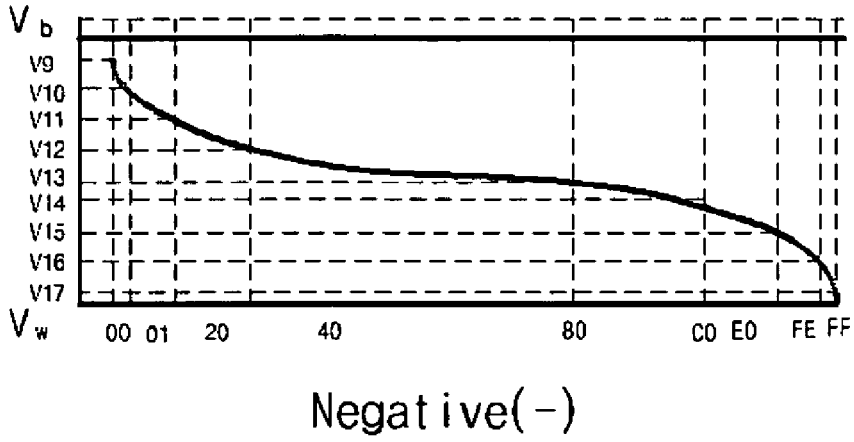

Generally, FIGS. 9A and 9B illustrate gamma curves of the data driver the IPS mode LCD device is driven with the common voltage according to principles of the present invention. Specifically, FIG. 9A illustrates a gamma curve having a positive (+) polarity when the first common voltage Vcom1 is applied to the pixel and FIG. 9B illustrates a gamma curve having a negative (−) polarity when the second common voltage Vcom2 is applied to the pixel. Vb and Bw respectively represent the status when the IPS mode LCD device is induced into black and white modes.

As discussed above, the IPS mode LCD device according to the principles of the present invention may be driven according to a dot inversion driving method using, at least in part, a plurality of common voltage switching devices S that selectively supply common voltages Vcom1 and Vcom2, each having different values. For example, the IPS mode LCD device may be driven according to an 8-bit format and the data driver 250 may output gray level voltages VD having 256-gray levels. According to the related art, if a value of a voltage at a pixel is V0(i.e., the highest illustrated voltage value having a positive polarity) when its polarity is inverted, the value of the voltage difference ΔV is equal to the difference between voltage values V0-V17(i.e., the lowest illustrated voltage value having a negative polarity). However, as shown in FIG. 9A, the highest voltage having the positive polarity (+) at the pixel is V0-Vb, wherein Vcom1 equals Vb. Accordingly, the highest voltage having the positive polarity (+) at the pixel may be represented as V0−Vcom1. Similarly, as shown in FIG. 9B, the lowest voltage having the negative polarity (−) at the pixel is V17−Vb, wherein Vb equals Vcom2. Accordingly, the lowest voltage having the positive polarity (+) at the pixel may be represented as V17−Vcom2. Accordingly, when voltages having the highest magnitudes at the pixel are inverted, the largest voltage difference ΔV may be represented by the following:

$$\Delta V=(V0-Vcom1)-(V17-Vcom2)=(V0\text{-}V17)+(Vcom2-Vcom1)$$

As a result, the voltage difference ΔV of inverted voltages having large absolute values when different common voltages are selectively applied is different from when a constant common voltage is applied. Therefore, when different common voltages are selectively applied to the pixel, the voltage difference ΔV generated by the data driver 250 may be reduced by an amount equal to the difference between the second common voltage Vcom2 and the first common voltage Vcom1(i.e., Vcom2−Vcom1) compared to when a common voltage having a constant value is applied to the pixel. For example, Vcom2−Vcom1 may be adjusted to V0-V17 such that the data driver 250 reduces the output voltage in half as compared when a constant common voltages is used as in the related art.

An operation of the IPS mode LCD in accordance with the principles of the present invention will now be described in greater detail with reference to FIG. 5.

When the IPS mode LCD device shown in FIG. 5 is driven according to a dot inversion driving method, horizontally and vertically adjacent ones of pixels are charged with voltages of opposite polarities. Therefore, if the first common voltage Vcom1 is applied to the $(n)^{th}\cdot(m)^{th}$ pixel upon switching the first switch S1 of the $(n)^{th}$ common voltage switching device S on, then the $(n)^{th}\cdot(m)^{th}$ pixel is charged with a voltage having a positive (+) polarity and the second common voltage Vcom2 is applied to the the $(n)^{th}\cdot(m+1)^{th}$ and $(n+1)^{th}\cdot(m)^{th}$ pixels upon switching the second switch S2 of the $(n+1)^{th}$ common voltage switching device S off to charge the $(n+1)^{th}\cdot(m)^{th}$ and $(n)^{th}\cdot(m+1)^{th}$ pixels with voltages having a negative (−) polarity.

Because, the IPS mode LCD device of the present invention selectively applies the first and second common voltages to the pixels, the data driver 250 may consume less power than the data driver of the related art.

Although the principles of the present invention have been described with reference to the application of two different common voltages applied to every other gate line, the number of different common voltage values may be increased. If the number of different common voltage values are increased, it will be appreciated that the number of switches within each common voltage switching device S must be increased accordingly.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

first and second gate lines;

first and second data lines;

first and second common voltage switching devices, the first common voltage switching device supplying one of a first common voltage and a second common voltage, the second common voltage switching device supplying the other of the first common voltage and the second common voltage, wherein a value of the first common voltage is different than a value of the second common voltage;

a first thin film transistor connected to the first data line and the first gate line;

a second thin film transistor connected to the second data line and the second gate line;

a third thin film transistor connected to the second data line and the first gate line;

a fourth thin film transistor connected to the first data line and the second gate line;

a first liquid crystal capacitor connected to the first thin film transistor and the first common voltage switching device except the second common voltage switching device;

a second liquid crystal capacitor connected to the second thin film transistor and the first common voltage switching device;

a third liquid crystal capacitor connected to the third thin film transistor and the second common voltage switching device except the first common voltage switching device; and a fourth liquid crystal capacitor connected to the fourth thin film transistor and the second common voltage switching device.

2. The device according to claim 1, wherein each of the first and second common voltage switching devices includes:

a first switch applying the first common voltage; and a second switch applying the second common voltage.

3. The device according to claim 2, wherein:

the first switch is a negative type switch that is switched on upon receipt of a signal voltage having a positive (+) polarity; and the second switch is a positive type switch that is switched on upon receipt of a signal voltage having a negative (−) polarity.

4. The device according to claim 3, wherein the first and second switches are connected to the same the same input terminal.

5. A method of driving a liquid crystal display device, comprising:

supplying a gate voltage to a gate line during a first frame;

supplying a first common voltage to a first liquid crystal capacitor and a third liquid crystal capacitor via a first common voltage switching device and supplying a second common voltage different from the first common voltage to a second liquid crystal capacitor and a fourth liquid crystal capacitor via a second common voltage switching device during the first frame;

supplying the gate voltage to the gate line during a second frame; and supplying the second common voltage to the first liquid crystal capacitor and the third liquid crystal capacitor via the first common voltage switching device and supplying the first common voltage to the second liquid crystal capacitor and the fourth liquid crystal capacitor through the second common voltage switching device during the second frame, wherein the supplying the first and second common voltages includes switching, within each of the first and second common voltage switching devices, from one of the first and second common voltages to the other of the first and second common voltages; and wherein the first and second liquid crystal capacitors are adjacent to each other along the gate line direction, and the third and fourth liquid crystal capacitors are adjacent to each other along the gate line direction, and wherein the first and fourth liquid crystal capacitors are adjacent to each other along the data line direction and the second and third liquid crystal capacitors are adjacent to each other along the data line direction.

6. The method according to claim 5, wherein the switching includes turning one of a first switch on while turning a second switch off or turning one of the first switch off while turning the second switch on.

7. The method according to claim 6, wherein the switching includes:

turning the first switch of the first common voltage switching device on to transmit the first common voltage during the first frame; and turning the second switch of the first common voltage switching device off to not transmit the second common voltage during the first frame.

8. The method according to claim 7, wherein the switching includes:

turning the first switch of the first common voltage switching off to not transmit the first common voltage during the second frame; and turning the second switch of the first common voltage switching device on to transmit the second common voltage during the second frame.

9. The method according to claim 8, wherein:

turning the first switch of the first common voltage switching device on includes applying a voltage having a positive (+) polarity to the first switch; and turning the second switch of the first common voltage switching device on includes applying a voltage having a negative (−) polarity to the second switch.

10. The method according to claim 9, further including applying the voltage having the positive (+) polarity to the first and second switches of the first common voltage switching device during the first frame.

11. The method according to claim 10, further including applying the voltage having the negative (−) polarity to the first and second switches of the first common voltage switching device during the second frame.

12. The method according to claim 6, wherein the switching includes:

turning the first switch of the second common voltage switching device off to not transmit the first common voltage during the first frame; and turning the second switch of the second common voltage switching device on to transmit the second common voltage during the first frame.

13. The method according to claim 12, wherein the switching includes:

turning the first switch of the second common voltage switching device on to transmit the first common voltage during the second frame; and turning the second switch of the second common voltage switching device off to not transmit the second common voltage during the second frame.

14. The method according to claim 13, wherein:

turning the first switch of the second common voltage switching device on includes applying a voltage having a positive (+) polarity to the first switch; and turning the second switch of the second common voltage switching device on includes applying a voltage having a negative (−) polarity to the second switch.

15. The method according to claim 14, further including applying the voltage having the positive (+) polarity to the first and second switches of the second common voltage switching device during the first frame.

16. The method according to claim 15, further including applying the voltage having the negative (−) polarity to the first and second switches of the second common voltage switching device during the second frame.

* * * * *